US009953533B1

(12) United States Patent
Graves

(10) Patent No.: US 9,953,533 B1
(45) Date of Patent: Apr. 24, 2018

(54) ROAD HAZARD WARNING SYSTEM

(71) Applicant: DENSO International America, Inc., Southfield, MI (US)

(72) Inventor: Jason Graves, Oceanside, CA (US)

(73) Assignee: DENSO International America, Inc., Southfield, MI (US)

( * ) Notice: Subject to any disclaimer, the term of this patent is extended or adjusted under 35 U.S.C. 154(b) by 0 days.

(21) Appl. No.: 15/333,757

(22) Filed: Oct. 25, 2016

(51) Int. Cl.
*G08B 1/00* (2006.01)
*G08G 1/16* (2006.01)
*G08G 1/00* (2006.01)

(52) U.S. Cl.
CPC ..... *G08G 1/162* (2013.01); *G08G 1/22* (2013.01)

(58) Field of Classification Search
CPC ..... G08G 1/161; G08G 1/162; H04W 4/046
See application file for complete search history.

(56) References Cited

U.S. PATENT DOCUMENTS

| | | | | |
|---|---|---|---|---|
| 6,985,089 | B2 | 1/2006 | Liu et al. | |
| 7,782,227 | B2 | 8/2010 | Boss et al. | |
| 2005/0259033 | A1* | 11/2005 | Levine | B60K 26/00 345/7 |
| 2008/0316053 | A1* | 12/2008 | Boss | G08G 1/162 340/902 |
| 2013/0190944 | A1* | 7/2013 | Brandin | G01C 21/26 701/1 |
| 2016/0321924 | A1* | 11/2016 | Lewis | G08G 1/096791 |
| 2017/0101054 | A1* | 4/2017 | Dusane | G08G 1/127 |

* cited by examiner

*Primary Examiner* — Hongmin Fan
(74) *Attorney, Agent, or Firm* — Harness, Dickey & Pierce, P.L.C.

(57) ABSTRACT

A hazard warning system for vehicles including hazard detection sensors and a primary transmitter for a primary vehicle configured to transmit information regarding a hazard and a path history of the primary vehicle. A secondary receiver for a secondary vehicle is configured to receive the information regarding the hazard detected by the hazard detection sensors, and the path history of the primary vehicle. A secondary vehicle control module is configured to notify a driver of the secondary vehicle of the hazard when the secondary vehicle is traveling along a path similar to that of the primary vehicle.

18 Claims, 3 Drawing Sheets

ROAD HAZARD WARNING SYSTEM

FIELD

The present disclosure relates to a road hazard warning system for vehicles.

BACKGROUND

This section provides background information related to the present disclosure, which is not necessarily prior art.

Vehicles equipped with dedicated short range communication (DSRC) typically provide position information and basic status information. While typical DSRC systems are suitable for their intended use, they are subject to improvement, particularly for vehicle platoon applications in which multiple vehicles travel in a platoon behind a lead platoon vehicle. With current vehicle platoons, issues may arise where the lead vehicle must stop quickly, such as due to a hazard. In some instances, when the lead vehicle stops quickly it may be difficult for the following vehicles to stop in time. The present teachings address various issues with existing DSRC systems and vehicle platoon applications. For example, the present teachings advantageously provide advance warnings of hazards by way of DSRC to platoon vehicles, as well as non-platoon vehicles.

SUMMARY

This section provides a general summary of the disclosure, and is not a comprehensive disclosure of its full scope or all of its features.

The present teachings provide for a hazard warning system for vehicles. The system includes hazard detection sensors and a primary transmitter for a primary vehicle that are configured to transmit information regarding a hazard and path history of the primary vehicle. A secondary receiver for a secondary vehicle is configured to receive the information regarding the hazard detected by the hazard detection sensors, and the path history of the primary vehicle. A secondary vehicle control module is configured to notify a driver of the secondary vehicle of the hazard when the secondary vehicle is traveling along a path similar to that of the primary vehicle.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of select embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
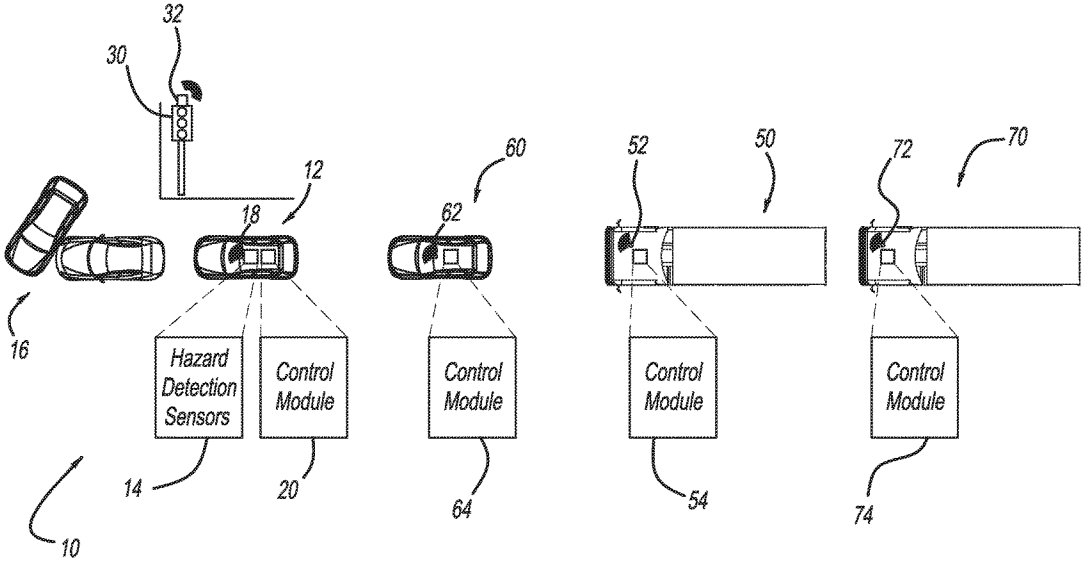
FIG. 1 illustrates a hazard warning system according to the present teachings.

FIG. 1 illustrates a hazard warning system according to the present teachings generally at reference numeral 10. The hazard warning system 10 is generally configured to warn drivers of vehicles that they are approaching a hazard so that the drivers can take appropriate action in view of the hazard. The hazard warning system 10 is configured for use with any suitable vehicles, such as passenger vehicles, mass transit vehicles, and commercial vehicles including trucks. The hazard warning system 10 can be used with any other suitable vehicles as well.

A primary vehicle 12 includes hazard detection sensors 14. The hazard detection sensors 14 can be any suitable sensors configured to identify any suitable hazards. For example, the hazard detection sensors 14 can be configured to detect one or more of a vehicle collision, disabled vehicle, traffic, hazardous road conditions, etc. The hazard detection sensors 14 can be any suitable hazard detection sensors, and can include any one or more of radar, lidar, sonar, braking sensors, collision detection sensors, road condition sensors, traction sensors, etc.

FIG. 1 illustrates an exemplary hazard in the form of a vehicle collision at reference numeral 16. Reference numeral 16 is used herein to refer to a hazard generally, as well as to the collision of FIG. 1, which according to the present teachings is an example of a hazard. When the hazard is, or includes, a vehicle collision 16, the hazard can be identified in any suitable manner. For example, if the primary vehicle 12 is involved in the collision 16, a collision detection sensor of the hazard detection sensors 14 will detect that the primary vehicle 12 is part of the collision 16. If the primary vehicle 12 is not part of the collision 16, the collision 16 can be detected in any other suitable manner. For example, if braking sensors of the primary vehicle 12 identify that the primary vehicle 12 has come to a stop, and the location of the stop is not at a stoplight or other standard location for a stop, the stop of the primary vehicle 12 can be considered to be due to a collision. The location of the stop of the primary vehicle 12 can be determined in any suitable manner, such as with GPS signals received by transmitter/receiver 18 and/or any other suitable signals received by the transmitter/receiver 18, such as dedicated short range communication (DSRC) signals for example. If the transmitter/receiver 18 receives signals from a traffic signal 30, and specifically from a DSRC transmitter 32 thereof, indicating that the traffic signal 30 is red, a control module 20 of the primary vehicle 12 can determine that the primary vehicle 12 has merely stopped in response to the traffic signal 30.

The hazard detection sensors 14 can be configured to detect any other hazards as well. For example, traction sensors of the hazard detection sensors 14 may be configured to detect hazardous road conditions (e.g., slick road conditions, such as due to rain or ice, loose gravel, etc.). Radar, lidar, and/or sonar of the hazard detection sensors 14 may be configured to detect heavy traffic conditions and any obstacles, such as other vehicles, pedestrians, and other stationary structures. The transmitter/receiver 18 of the primary vehicle 12 is configured to receive notification of any hazards, such as transmissions from other vehicles, police, road commission alerts, and alerts from any other source.

In this application, the term "module" may be replaced with the term "circuit." The term "module" may refer to, be part of, or include processor hardware (shared, dedicated, or group) that executes code and memory hardware (shared, dedicated, or group) that stores code executed by the processor hardware. The code is configured to provide the features of the modules, controllers, and systems described herein. The term memory hardware is a subset of the term computer-readable medium. The term computer-readable medium, as used herein, does not encompass transitory electrical or electromagnetic signals propagating through a medium (such as on a carrier wave). The term computer-readable medium is therefore considered tangible and non-transitory. Non-limiting examples of a non-transitory computer-readable medium are nonvolatile memory devices (such as a flash memory device, an erasable programmable read-only memory device, or a mask read-only memory device), volatile memory devices (such as a static random access memory device or a dynamic random access memory device), magnetic storage media (such as an analog or digital magnetic tape or a hard disk drive), and optical storage media (such as a CD, a DVD, or a Blu-ray Disc).

The control module 20 of the primary vehicle 12 is configured to process data gathered by the hazard detection sensors 14, as well as transmissions (such as DSRC transmissions) and GPS signals received by the transmitter/receiver 18, to identify the type and location of any detected hazards, such as the collision 16 illustrated. The control module 20 is further configured to monitor the path of the primary vehicle 12, such as by way of GPS. The control module 20 is also configured to operate the transmitter/receiver 18 to transmit data regarding any detected hazards, such as the collision 16, as well as historical path information and current location of the primary vehicle 12, as well as any suitable operating parameters of the vehicle 12, such as speed, heading, etc. The transmitter/receiver 18 transmits such information using any suitable transmission protocol, such as DSRC, for receipt by any suitable vehicle or roadside station.

A secondary vehicle 50 includes a transmitter/receiver 52, which can be any suitable transmitter/receiver including a DSRC transmitter/receiver and a GPS receiver. The transmitter/receiver 52 is configured to receive data transmitted by the transmitter/receiver 18 of the primary vehicle 12, which can include information regarding any hazard detected by the hazard detection sensors 14, as well as path information of the primary vehicle 12. Data received by the transmitter/receiver 52 is processed by control module 54 of the secondary vehicle 50.

The control module 54 is configured to notify a driver of the secondary vehicle 50 of the hazard 16 detected by the hazard detection sensors 14 in any suitable manner, such as with any suitable audible alert and/or any suitable visual alert, such as a visual alert displayed on an instrument cluster, heads up display, and/or center counsel display of the secondary vehicle 50. The control module 54 is also configured to determine if the secondary vehicle 50 is traveling along a path similar to that of the primary vehicle 12. If the secondary vehicle 50 is traveling along a path similar or identical to the path traveled by the primary vehicle 12, the secondary vehicle 50 is likely to encounter the same hazard 16 that the primary vehicle 12 encountered. The driver of the secondary vehicle 50 will thus have an early warning of the hazard 16 and be able to prepare for the hazard 16.

For example, if the hazard 16 is ice, the driver of the secondary vehicle 50 will have extra time to reduce the speed of the secondary vehicle 50. If the hazard 16 is heavy traffic, the driver of the secondary vehicle 50 may be able to use the information regarding the traffic to reroute the secondary vehicle 50 and avoid the traffic. If the hazard 16 is a collision, the driver of the secondary vehicle 50 will have extra time to stop the secondary vehicle 50.

If the status information of the primary vehicle 12 received by the transmitter/receiver 52 of the secondary vehicle 50 indicates that the primary vehicle 12 has come to a stop due to the hazard 16, such as when the hazard 16 is a collision blocking the path of the primary vehicle 12, the control module 54 is configured to consider the stopped primary vehicle 12 to essentially be part of the hazard 16, and calculate a minimum stopping distance of the secondary vehicle 50 relative to the primary vehicle 12 and/or the hazard 16. The minimum stopping distance is based at least on the speed and weight of the secondary vehicle 50, and advantageously informs the driver of the secondary vehicle 50 when the brakes of the secondary vehicle 50 must be engaged in order to bring the secondary vehicle 50 to a stop prior to reaching the primary vehicle 12. The minimum stopping distance can be calculated to include a driver reaction time buffer that increases the minimum stopping distance any suitable amount to take into account reaction time of the driver.

The transmitter/receiver 52 of the secondary vehicle 50 can receive information regarding any hazard 16 detected by the hazard detection sensors 14, operating parameters of the primary vehicle 12, and path history of the primary vehicle 12 directly from the primary vehicle 12, or by way of intermediate vehicle 60. The intermediate vehicle 60 includes a transmitter/receiver 62, which can be any suitable transmitter/receiver, including a DSRC transmitter/receiver and a GPS receiver. The transmitter/receiver 62 is configured to receive information transmitted from the transmitter/receiver 18 of the primary vehicle 12 regarding any hazard detected, as well as path history and operating parameters of the primary vehicle 12. A control module 64 of the intermediate vehicle 60 is configured to retransmit such information using the transmitter/receiver 62, as well as transmit operating parameters and path history of the intermediate vehicle 60. Any suitable operating parameters of the vehicle 60 can be transmitted, such as speed, heading, path history, and intended route. Such transmissions from the intermediate vehicle 60 advantageously provide the secondary vehicle 50, as well as any other surrounding vehicle, with an early warning of the hazard 16, and effectively increasing the range of the transmitter/receiver 18 of the primary vehicle 12.

Knowing the operating parameters and the path of the intermediate vehicle 60 also helps the driver of the secondary vehicle 50 take any action necessary in response to the intermediate vehicle 60. For example, if the transmitted operating status of the intermediate vehicle 60 indicates that the intermediate vehicle 60 has stopped, such as due to the primary vehicle 12 having stopped at the hazard 16, the control module 54 of the secondary vehicle 50 is configured to take the position of the intermediate vehicle 60 into account when calculating the minimum stopping distance for the secondary vehicle 50. Although FIG. 1 illustrates only a single intermediate vehicle 60, any suitable number of intermediate vehicles 60 can be present, and can be taken into account by the control module 54 when the intermediate vehicles include a DSRC transmitter/receiver and control module similar to that of the intermediate vehicle 60.

The secondary vehicle 50 can be operated on its own, or as part of a vehicle platoon. For example, the secondary vehicle 50 can be a lead platoon vehicle followed by a following platoon vehicle 70. The platoon of vehicles can include any suitable number of following vehicles, even though FIG. 1 illustrates only a single following platoon vehicle 70. As with standard vehicle platoons, the following platoon vehicle 70 follows the lead platoon vehicle 50 at a suitable distance. The following platoon vehicle 70 can be directly operated by the lead platoon vehicle 50, or operated in a manner so as to mimic the operation of the lead platoon vehicle 50, such as with respect to speed, heading, acceleration, and braking, for example.

The following platoon vehicle 70 includes any suitable transmitter/receiver 72, such as any suitable DSRC and GPS transmitter/receiver 72. The transmitter/receiver 72 is configured to receive information transmitted from the transmitter/receiver 72 of the lead platoon vehicle 50 regarding the hazard 16, as well as operating parameters and path of the primary vehicle 12, the secondary vehicle 50, and any intermediate vehicle(s) 60. Based on this information, a control module 74 of the following platoon vehicle 70 is configured to calculate a minimum stopping distance (which can include a driver reaction buffer) for the following platoon vehicle 70 relative to at least one of the lead platoon vehicle 50, the hazard 16, the primary vehicle 12, and the intermediate vehicle 60 based on at least the weight and speed of the following platoon vehicle 70. The control module 74 is configured to alert a driver of a following platoon vehicle 70 of such calculated minimum stopping distances, and alert the driver when any of the minimum stopping distances have been reached. The minimum stopping distances can include any suitable buffer to take into account reaction time of the driver. If the control module 74 determines that the following platoon vehicle 70 has reached its minimum stopping distance relative to at least one of the lead platoon vehicle 50, the hazard 16, the primary vehicle 12, and the intermediate vehicle 60, the control module 74 can alert the driver of the following platoon vehicle 70 and instruct the driver of the following platoon vehicle 70 to disengage from the platoon.

The transmitter/receiver 72 of the following platoon vehicle 70 can also be in receipt of basic safety messages (BSMs) transmitted by the transmitter/receiver 52 of the lead platoon vehicle 50. For example, when the control module 54 of the lead platoon vehicle 50 determines that the lead platoon vehicle 50 has reached a minimum stopping distance with respect to any one or more of the hazard 16, the primary vehicle 12, and/or the intermediate vehicle 60, the control module 54 of the lead platoon vehicle 50 is configured to generate an alert to the following platoon vehicle 70 (transmitted by the transmitter/receiver 52 and received by the transmitter/receiver 72) instructing the driver of the following platoon vehicle 70 to disengage from the platoon. The BSM is received by the transmitter/receiver 72 and processed by the control module 74, which generates the alert to the driver instructing the driver to disengage from the platoon.

Figure 2:
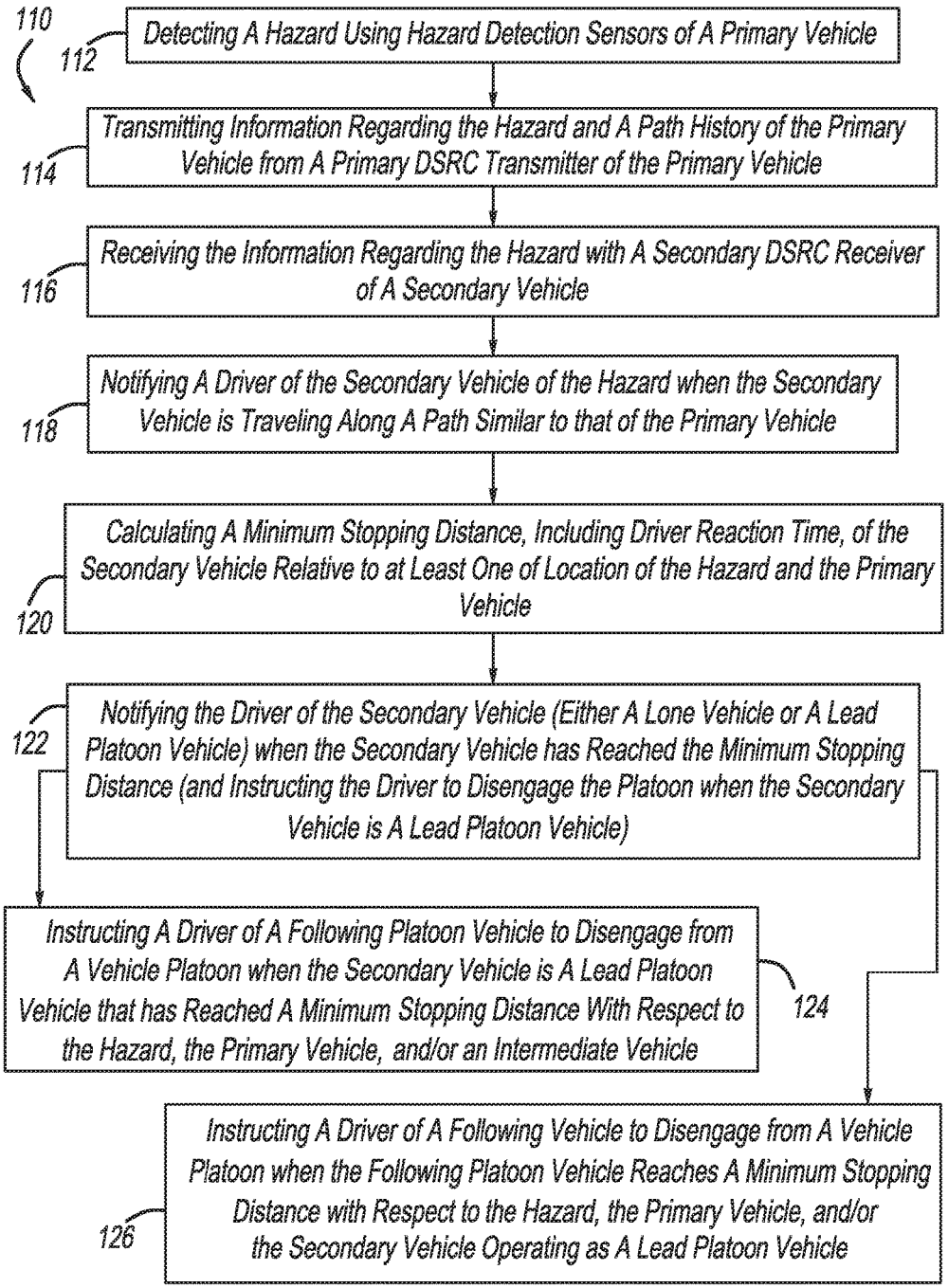
FIG. 2 illustrates a method according to the present teachings for warning vehicles of hazards.

With continued reference to FIG. 1 and additional reference to FIG. 2, a method 110 of warning vehicles of hazards, such as by using the hazard warning system 10 for example, will now be described. With initial reference to block 112, any suitable hazard, such as the collision 16 or any of the other exemplary hazards described by the present teachings, is detected by the hazard detection sensors 14 of the primary vehicle 12. At block 114, information regarding the hazard 16 and a path history of the primary vehicle 12 is transmitted by the DSRC transmitter/receiver 18 of the primary vehicle 12. At block 116, information regarding the hazard is received by the transmitter/receiver 52 of the secondary vehicle 50. At block 118, the control module 54 of the secondary vehicle 50 notifies the driver of the secondary vehicle 50 of the hazard when the secondary vehicle 50 is traveling along a path similar to that of the primary vehicle 12.

At block 120, the control module 54 calculates a minimum stopping distance, which includes any suitable driver reaction time buffer, of the secondary vehicle 50 relative to at least one of location of the hazard 16 and location of the primary vehicle 12. At block 122, the control module 54 notifies the driver of the secondary vehicle 50, which as described above can be operated as either a lone vehicle or a lead platoon vehicle, when the secondary vehicle 50 has reached the minimum stopping distance. When the secondary vehicle 50 is the lead platoon vehicle, the control module 54 is configured to instruct the driver of the secondary vehicle 50 to disengage the platoon when the minimum stopping distance has been reached.

With reference to block 124, the control module 74 of following platoon vehicle 70 is configured to instruct a driver of the following vehicle 70 to disengage from the platoon when the lead platoon vehicle 50 reaches a minimum stopping distance with respect to the hazard, the primary vehicle 12, and/or the intermediate vehicle 60. With reference to block 126, the control module 74 of the following platoon vehicle 70 is configured to instruct the driver thereof to disengage from the vehicle platoon when the following platoon vehicle 70 reaches a minimum stopping distance with respect to the hazard 16, the primary vehicle 12, the intermediate vehicle 60, and/or the lead platoon vehicle 50.

Figure 3:
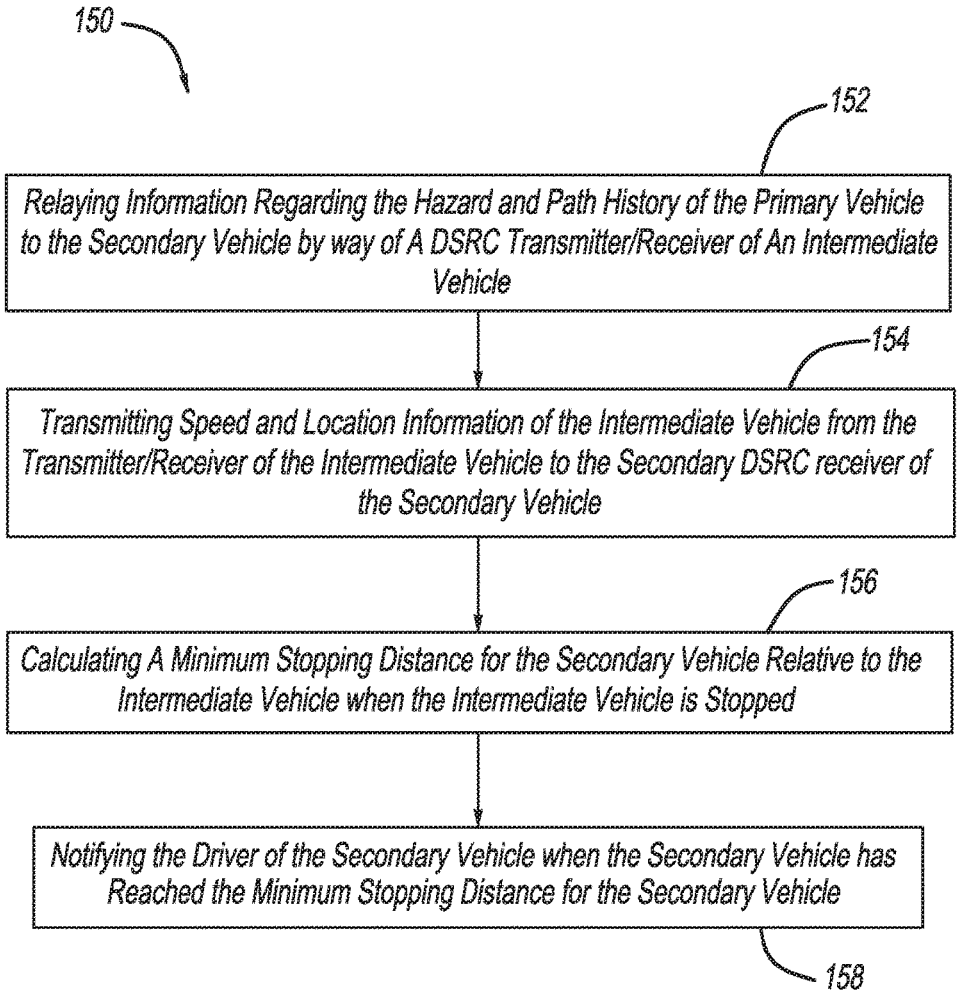
FIG. 3 illustrates a further method according to the present teachings for warning vehicles of hazards.

FIG. 3 illustrates a method 150 according to the present teachings including the intermediate vehicle 60. With reference to block 152, the control module 64 of the intermediate vehicle 60 is configured to relay information regarding the hazard and path history of the primary vehicle 12 to the secondary vehicle 50 by way of the DSRC transmitter/receiver 62 of the intermediate vehicle 60. At block 154, the control module 64 transmits, by way of the transmitter/receiver 62, speed and location of the intermediate vehicle 60 to the transmitter/receiver 52 of the secondary vehicle 50. With reference to block 156, the control module 54 calculates a minimum stopping distance, including any suitable driver reaction buffer, for the secondary vehicle 50 relative to the intermediate vehicle 60 when the intermediate vehicle 60 is stopped. At block 158, the control module 54 of the secondary vehicle 50 notifies the driver of the secondary vehicle 50 that the secondary vehicle 50 has reached the minimum stopping distance for the secondary vehicle 50, and keeps the driver informed of the minimum stopping distance, so that the driver of the secondary vehicle 50 can take action to avoid the intermediate vehicle 60.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A hazard warning system comprising:

hazard detection sensors and a primary transmitter for a primary vehicle that are configured to transmit information regarding a hazard and a path history of the primary vehicle;

a secondary receiver for a secondary vehicle configured to receive the information regarding the hazard detected by the hazard detection sensors and the path history of the primary vehicle;

a secondary vehicle control module configured to notify a driver of the secondary vehicle of the hazard when the secondary vehicle is traveling along a path similar to that of the primary vehicle;

a receiver for the primary vehicle, the receiver configured to receive signals from roadside equipment (RSE), including RSE associated with a traffic signal; and braking sensors for the primary vehicle configured to detect when brakes of the primary vehicle are engaged;

wherein the transmitter is configured to transmit information regarding the braking status of the primary vehicle, and whether the brakes were engaged in response to the traffic signal; and wherein the secondary vehicle control module is configured to notify the driver of the secondary vehicle of the hazard when the braking sensors of the primary vehicle detect that the brakes of the primary vehicle have been engaged to bring the primary vehicle to a stop that is not in response to the traffic signal.

2. The hazard warning system of claim 1, wherein the hazard includes at least one of a vehicle collision, disabled vehicle, traffic, and a hazardous road condition.

3. The hazard warning system of claim 1, wherein the hazard detection sensors include at least one of radar, lidar, sonar, braking sensors, collision detection sensors, traction sensors, and road condition sensors; and wherein primary transmitter and the secondary receiver are each configured to transmit and receive information by way of dedicated short range communication (DSRC).

4. The hazard warning system of claim 1, wherein the hazard is a collision involving the primary vehicle detected by collision detection sensors of the hazard detection sensors.

5. The hazard warning system of claim 1, wherein the hazard is a collision ahead of the primary vehicle detected by braking sensors of the primary vehicle, activation of the brakes is interpreted by the secondary vehicle control module as the primary vehicle stopping due to a collision ahead of the primary vehicle.

6. The hazard warning system of claim 1, wherein the secondary vehicle control module of the secondary vehicle is configured to calculate a minimum stopping distance of the secondary vehicle relative to at least one of location of the hazard and the primary vehicle, and notify the driver of the secondary vehicle when the minimum stopping distance has been reached;

wherein the minimum stopping distance includes a driver reaction time buffer.

7. The hazard warning system of claim 1, further comprising an intermediate vehicle between the primary vehicle and the secondary vehicle, the intermediate vehicle including an intermediate transmitter and receiver, and associated intermediate control module configured to:

receive information regarding the hazard from the primary vehicle; and transmit the information regarding the hazard to the secondary vehicle along with speed and route of the secondary vehicle.

8. The hazard warning system of claim 7, wherein:

the secondary vehicle control module is configured to notify the driver of the secondary vehicle of the speed and location of the intermediate vehicle, and when the intermediate vehicle is stopped; and the secondary vehicle control module is configured to calculate a minimum stopping distance for the secondary vehicle relative to the intermediate vehicle, and notify the driver of the secondary vehicle when the minimum stopping distance has been reached.

9. The hazard warning system of claim 1, wherein the secondary vehicle is a lead platoon vehicle.

10. The hazard warning system of claim 1, wherein the secondary vehicle is a lead platoon vehicle leading a following platoon vehicle of a vehicle platoon;

wherein a receiver for the following platoon vehicle is configured to receive the information regarding the hazard detected by the hazard detection sensors and path history of the primary vehicle from a transmitter of the secondary vehicle operating as the lead platoon vehicle.

11. The hazard warning system of claim 10, wherein a vehicle control module of the following platoon vehicle is configured to command the driver of the following platoon vehicle to disengage from the platoon when the secondary vehicle operating as the lead platoon vehicle reaches a minimum stopping distance for the lead platoon vehicle, which includes a driver reaction buffer distance, relative to at least one of the primary vehicle, the hazard, and an intermediate vehicle between the hazard and the secondary vehicle operating as the lead platoon vehicle.

12. The hazard warning system of claim 10, wherein the secondary vehicle control module of the secondary vehicle operating as the lead platoon vehicle is configured to transmit a basic safety message to the following platoon vehicle by way of a transmitter instructing a driver of the following platoon vehicle to disengage from the vehicle platoon when the secondary platoon vehicle operating as the lead platoon vehicle reaches a minimum stopping distance, including a driver reaction buffer distance, relative to at least one of the hazard, the primary vehicle, and an intermediate vehicle stopped between the hazard and the secondary vehicle operating as the lead platoon vehicle.

13. The hazard warning system of claim 10, wherein a control module of the following platoon vehicle is configured to instruct a driver of the following platoon vehicle to disengage from the vehicle platoon when the following platoon vehicle reaches a minimum stopping distance with respect to at least one of the hazard, the primary vehicle, an intermediate vehicle, and/or the secondary vehicle operating as the lead platoon vehicle.

14. A method for warning vehicles of hazards comprising:

detecting a hazard using hazard detection sensors of a primary vehicle;

transmitting information regarding the hazard and a path history of the primary vehicle from a primary transmitter of the primary vehicle;

receiving the information regarding the hazard with a secondary receiver of a secondary vehicle;

notifying a driver of the secondary vehicle of the hazard when the secondary vehicle is traveling along a path similar to that of the primary vehicle;

wherein the hazard includes at least one of a vehicle collision, disabled vehicle, traffic, and hazardous road conditions;

relaying information regarding the hazard and the path history of the primary vehicle to the secondary vehicle by way of a transmitter/receiver of an intermediate vehicle;

transmitting speed and location information of the intermediate vehicle from the transmitter/receiver of the intermediate vehicle to the secondary receiver of the secondary vehicle;

calculating a minimum stopping distance for the secondary vehicle relative to the intermediate vehicle when the intermediate vehicle is stopped; and notifying the driver of the secondary vehicle when the secondary vehicle has reached the minimum stopping distance for the secondary vehicle.

15. The method of claim 14, further comprising:

calculating a minimum stopping distance, including driver reaction time, of the secondary vehicle relative to at least one of location of the hazard and the primary vehicle; and notifying the driver of the secondary vehicle when the secondary vehicle has reached the minimum stopping distance.

16. The method of claim 14, wherein when the secondary vehicle is a lead platoon vehicle.

17. The method of claim 16, further comprising transmitting a basic safety message to a following platoon vehicle by way of a transmitter instructing a driver of the following platoon vehicle to disengage from a vehicle platoon when the secondary platoon vehicle operating as a lead platoon vehicle reaches a minimum stopping distance, including a driver reaction buffer distance, relative to at least one of the hazard, the primary vehicle, and an intermediate vehicle stopped between the hazard and the secondary vehicle operating as the lead platoon vehicle.

18. The method of claim 16, further comprising instructing a driver of a following platoon vehicle to disengage from a vehicle platoon when the following platoon vehicle reaches a minimum stopping distance with respect to at least one of the hazard, the primary vehicle, an intermediate vehicle between the primary vehicle and the following platoon vehicle, and/or the secondary vehicle operating as a lead platoon vehicle.

* * * * *